US006047845A

United States Patent [19]

Rapaz

[11] Patent Number: 6,047,845

[45] Date of Patent: Apr. 11, 2000

[54] DINNER PLATE

[76] Inventor: Antonio R. Rapaz, 9498 Tupper St., Chilliwack, BC, Canada, V2P 4G4

[21] Appl. No.: 09/250,245

[22] Filed: Feb. 16, 1999

[51] Int. Cl.[7] ..... A47G 19/02

[52] U.S. Cl. ..... 220/575; 220/574.1; 220/572; 220/501

[58] Field of Search ..... 220/575, 574, 220/574.1, 571, 572, 571.1, 527, 529, 501; 210/455, 464, 479, 477, 473; 99/425

[56] References Cited

U.S. PATENT DOCUMENTS

| | | | |
|---|---|---|---|
| 573,983 | 12/1896 | Kerner | 220/572 |
| 1,017,455 | 2/1912 | Otto | 220/572 |
| 2,671,239 | 3/1954 | Wisner | 220/501 |
| 4,798,307 | 1/1989 | Evrard | 220/501 |
| 5,176,282 | 1/1993 | Rapaz | 220/575 |
| 5,341,953 | 8/1994 | Forester | 220/575 |
| 5,676,275 | 10/1997 | Khattar | 220/575 |

FOREIGN PATENT DOCUMENTS

| | | | |
|---|---|---|---|
| 117379 | 7/1918 | United Kingdom | 220/575 |

*Primary Examiner*—Stephen Castellano
*Attorney, Agent, or Firm*—Oyen Wiggs Green & Mutala

[57] ABSTRACT

A dinner plate for serving, consuming and storing greasy foods, such as bacon, sausages or steaks. The plate has an inclined surface to facilitate drainage of greasy juices and the like to a lower side of the plate. The plate further includes a food receiving platform removably supported at an elevation above the inclined surface. The platform has a plurality of apertures formed therein to permit passage of fluid through the platform to the lower end of the plate.

8 Claims, 2 Drawing Sheets

DINNER PLATE

TECHNICAL FIELD

This application pertains to a dinner plate for serving, consuming and storing greasy foods, such as bacon, sausages or steaks. The plate has an inclined surface to facilitate drainage of greasy juices and the like to a lower end of the plate.

BACKGROUND

The applicant is the owner of U.S. Pat. No. 5,176,282, which issued on Jan. 5, 1993, for a dinner plate having an inclined surface. The '282 plate includes a food supporting plane having a plurality of spaced, parallel ribs with parallel troughs formed therebetween. While the '282 dinner plate works very well, one drawback is that food particles tend to accumulate in the troughs formed in the food supporting plane. Somewhat more care is therefore required to clean the '282 plate after each use as compared to conventional dinner plates.

Another drawback of the '282 dinner plate design is that the greasy drippings which collect at one end of the plate are not hidden from view and may be considered unappetizing by some users. Further, the provision of a collection area for holding the greasy drippings means that the entire plate surface is not available for serving, consuming or storing food.

The need has therefore arisen for an improved dinner plate having an inclined surface and which addresses the above shortcomings.

SUMMARY OF INVENTION

In accordance with the invention a plate for holding food is provided. The plate includes a base for resting on a support surface; an upwardly facing inclined surface supported by said base at an angle relative to said support surface when said base rests on said support surface; a wall extending about the perimeter of the inclined surface; a food retaining barrier projecting upwardly from the inclined surface and extending across the inclined surface in a direction generally perpendicular to the direction of inclination thereof, wherein the barrier subdivides the inclined surface into a first portion and a second portion, and wherein the barrier is interrupted at at least one location to permit the flow of fluid from the first portion to the second portion; and a food receiving platform removably supported at an elevation above the second portion, the platform having a plurality of apertures formed therein permitting passage of fluid through the platform to the second portion.

Preferably the platform support means comprises a ledge formed on the barrier on a side thereof facing the second portion; and a plurality of legs projecting from the wall at spaced intervals. The platform has a flat top surface. The platform support means maintains the top surface in a plane generally co-planar with an uppermost surface of the barrier. In one embodiment, the plate is generally circular and said food receiving platform is generally semi-circular.

Preferably the barrier is linear and is interrupted in a central portion thereof to form a central gap. The plate may further include a flat rim extending around its perimeter. The wall slopes downwardly and inwardly from the rim to the perimeter of the inclined surface.

BRIEF DESCRIPTION OF DRAWINGS

In drawings which illustrate a preferred embodiment of the invention but which should not be construed as restricting the spirit and scope thereof.

DESCRIPTION

This application relates to a dinner plate generally designated 10. Plate 10 includes a base 12 for resting on a flat support surface, such as a table. Plate 10 is an improvement over the applicant's prior dinner plate design described in U.S. Pat. No. 5,176,282, the disclosure of which is hereby incorporated by reference.

Figure 1:
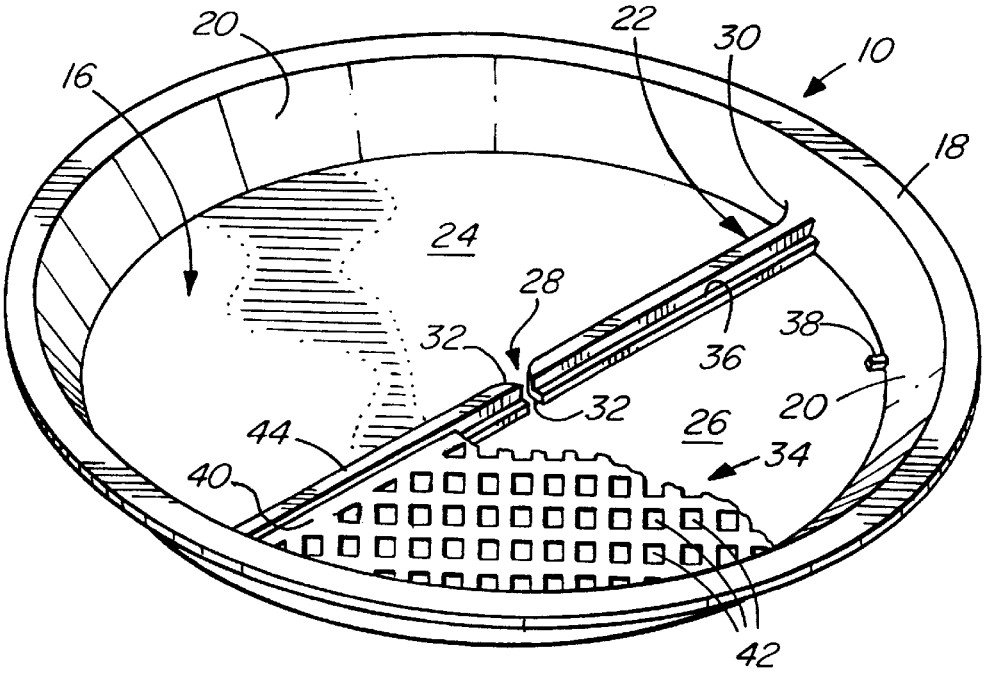
FIG. 1 is an isometric view of the applicant's dinner plate showing a fragmented portion of the food receiving platform.
Figure 2:
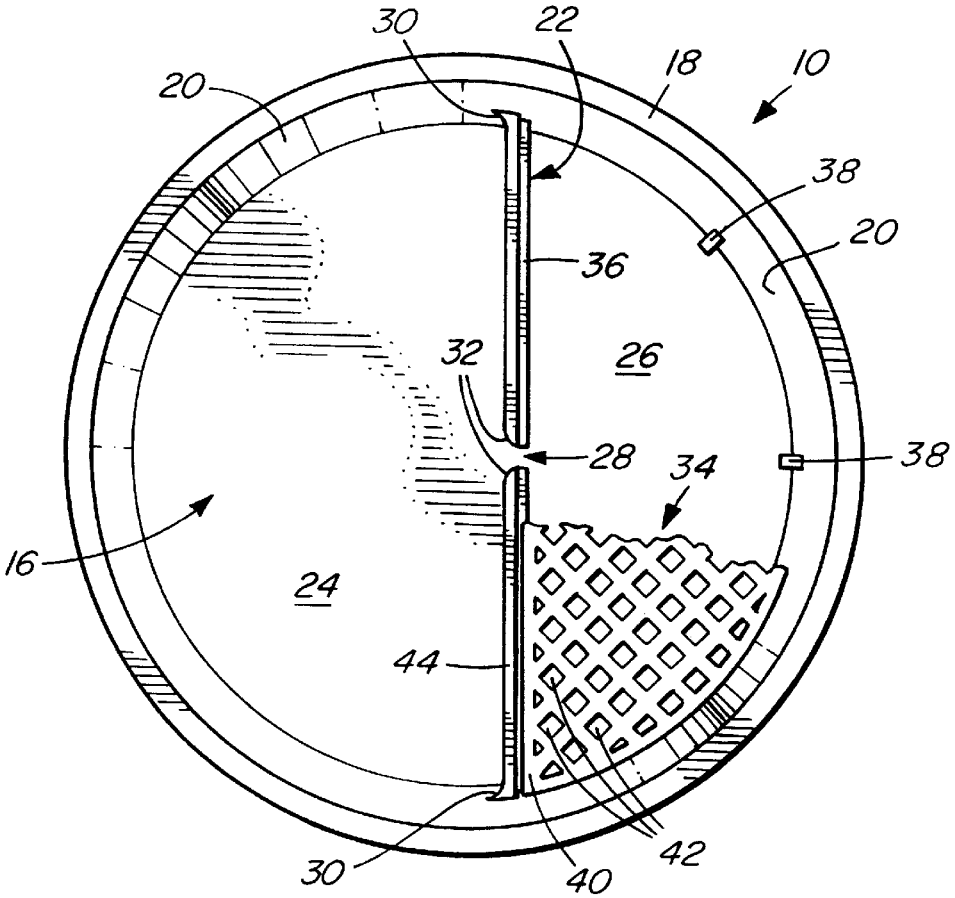
FIG. 2 is a top plan view of the dinner plate of FIG. 1.
Figure 3:
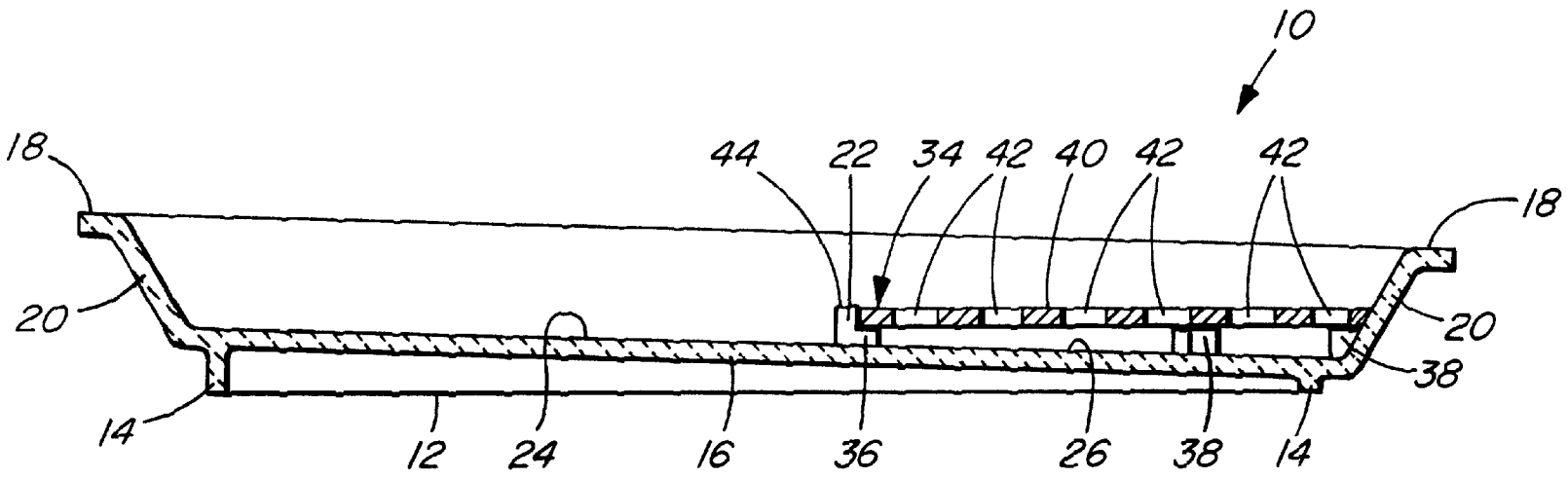
FIG. 3 is a longitudinal sectional view of the dinner plate of FIG. 1.

As shown best in FIG. 3, base 12 includes legs 14 for maintaining an inclined surface 16 at an angle relative to the table top or other support surface. Plate 10 further includes an upper rim 18 which extends around the perimeter of the plate and a tapered sidewall 20 which preferably slopes inwardly from rim 18 to the perimeter of surface 16.

A barrier 22 extends linearly across inclined surface 16 in a direction generally perpendicular to the direction of its inclination. Barrier 22 subdivides surface 16 into a first portion 24 and a second portion 26. Barrier 22 is interrupted in a central portion thereof to form a gap 28. Gap 28 permits the flow of fluids from first portion 24 into second portion 26 as described further below. In order to facilitate such fluid flow, the end portions 30 of barrier 22 facing first portion 24 may be rounded where they merge with wall 20. The mid-portion 32 of barrier 22 defining gap 28 may also be gently rounded. Barrier 22 may be slightly angled inwardly toward gap 28 to facilitate fluid flow from said first portion 24 through said gap 28 into second portion 26.

Plate 10 further includes a generally semi-circular platform 34 which is supported at an elevation above plate second portion 26. More particularly, platform 34 is supported on a ledge 36 formed on the side of barrier 22 facing second portion 26 and by a plurality of legs 38 which project inwardly from wall 20 at spaced intervals. Platform 34 has a flat, food receiving upper surface 40 and a plurality of apertures 42 extending therethrough. Apertures 42 permit the passage of fluids, such as grease drippings, from upper surface 40 into plate second portion 26. As shown best in FIG. 3, platform upper surface 40 is preferably supported to extend in approximately the same plane as an upper surface 44 of barrier 22. Platform 34 may be constructed from any relatively rigid material suitable for serving and consuming food.

In use, plate 10 is designed to reduce intake of fatty greases and the like when eating meals served thereon. Removable platform 34 acts as a support surface for receiving greasy foods, such as steaks, bacon or sausages. Greasy fluid drains through apertures 42 and into second portion 26 which functions as a grease collection sump. Since plate 10 is inclined, grease accumulating in second portion 26 will not flow into first portion 24. First portion 24 is intended to hold food items which are less greasy in nature, such as eggs, salads and the like. However, any drippings from food served in first portion 24 will also flow into second portion 26 through barrier gap 28.

Plate 10 achieves two important advantages. First, the grease and other fluids collected in plate second portion 26 is hidden from view in normal use. Secondly, substantially all of the surface area of plate 10 is available holding food, namely first portion 24 of inclined surface 16 and platform 34.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A plate for holding food comprising:

(a) a base for resting on a support surface;

(b) an upwardly facing inclined surface supported by said base at an angle relative to said support surface when said base rests on said support surface;

(c) a wall extending about the perimeter of said inclined surface;

(d) a food retaining barrier projecting upwardly from said inclined surface and extending across said inclined surface, wherein said barrier subdivides said inclined surface into a first portion and a second portion, and wherein said barrier is interrupted at at least one location to form a gap permitting the flow of fluid from said first portion to said second portion; and (e) a food receiving platform removably supported at an elevation above said second portion, said platform having a plurality of apertures formed therein permitting passage of fluid through said platform to said second portion.

2. The plate of claim 1, wherein said barrier comprises wall segments angled toward said gap to facilitate flow of fluid from said first portion through said gap.

3. A plate for holding food comprising:

(a) a base for resting on a support surface;

(b) an upwardly facing inclined surface supported by said base at an angle relative to said support surface when said base rests on said support surface;

(c) a wall extending about the perimeter of said inclined surface;

(d) a food retaining barrier projecting upwardly from said inclined surface and extending across said inclined surface in a direction generally perpendicular to the direction of inclination thereof, wherein said barrier subdivides said inclined surface into a first portion and a second portion, and wherein said barrier is interrupted at at least one location to permit the flow of fluid from said first portion to said second portion; and (e) a food receiving platform removably supported at an elevation above said second portion, said platform having a plurality of apertures formed therein permitting passage of fluid through said platform to said second portion.

4. The plate of claim 3, wherein said platform support means comprises:

(a) a ledge formed on said barrier on a side thereof facing said second portion; and (b) a plurality of legs projecting from said wall at spaced intervals.

5. The plate of claim 3, wherein said platform comprises a flat top surface and wherein said platform support means maintains said top surface in a plane generally co-planar with an uppermost surface of said barrier.

6. The plate of claim 3, wherein said barrier is linear and is interrupted in a central portion thereof to form a central gap.

7. The plate of claim 3, wherein said plate further comprises a flat rim extending around its perimeter and wherein said wall slopes downwardly and inwardly from said rim to said inclined surface.

8. The plate of claim 3, wherein said plate is generally circular and said food receiving platform is generally semicircular.

* * * * *